US005454227A

United States Patent [19]

Straub et al.

[11] Patent Number: 5,454,227

[45] Date of Patent: Oct. 3, 1995

[54] AIR SEPARATION METHOD AND APPARATUS

[75] Inventors: Joseph Straub, North Haledon; Neil Nogg, Summit, both of N.J.

[73] Assignee: The BOC Group, Inc., New Providence, N.J.

[21] Appl. No.: 292,127

[22] Filed: Aug. 17, 1994

[51] Int. Cl.[6] ..... F25J 3/02

[52] U.S. Cl. ..... 62/25; 62/41

[58] Field of Search ..... 62/24, 25, 38, 62/41

[56] References Cited

U.S. PATENT DOCUMENTS

| | | | |
|---|---|---|---|
| 5,341,646 | 8/1994 | Agrawal et al. | 62/41 |
| 5,361,590 | 11/1994 | Rathbone | 62/25 |
| 5,392,609 | 2/1995 | Girault et al. | 62/25 |

*Primary Examiner*—Ronald C. Capossela

*Attorney, Agent, or Firm*—David M. Rosenblum; Larry R. Cassett

[57] ABSTRACT

An air separation method and apparatus in which a compressed and purified air stream is divided into first and second subsidiary streams. The air of the first subsidiary stream is rectified within an air separation unit comprising higher and lower pressure columns. A liquid oxygen product is pumped from the lower pressure column to a desired above-atmospheric delivery pressure. At the same time, the second subsidiary stream is expanded to substantially the delivery pressure by an expansion machine and the two streams are then counter-currently added to a mixing column to vaporize the liquid stream and thereby produce a product stream at the delivery pressure. One or more liquid refrigerant streams are removed from the mixing column and added to the lower pressure column to refrigerate the process. The addition of a liquid increases the liquid to vapor ratio within the lower pressure column to in turn increase production.

14 Claims, 2 Drawing Sheets

AIR SEPARATION METHOD AND APPARATUS

BACKGROUND OF THE INVENTION

The present invention relates to an air separation method and apparatus for producing a gaseous oxygen product at an above-atmospheric delivery pressure. More particularly, the present invention relates to such an air separation and method and apparatus in which the gaseous oxygen product is produced from a pumped liquid oxygen stream which is vaporized within a mixing column. Even more particularly, the present invention relates to such a method and apparatus in which air is separated within an air separation plant refrigerated by air expansion. Still even more particularly, the present invention relates to such an air separation method and apparatus in which the refrigeration is supplied from the mixing column to a lower pressure column of the air separation plant.

A variety of industrial processes require gaseous oxygen to be produced at an above-atmospheric delivery pressure. Such industrial processes include steel-making, glass-making and etc. Typically, air after having been filtered is compressed, purified and then cooled to a temperature suitable for its rectification by cryogenic distillation. The air is then introduced into an air separation unit that has higher and lower pressure columns connected to one another in a heat transfer relationship via a condenser/reboiler located within the lower pressure column. The air separates within the higher pressure column to produce a nitrogen-rich fraction and a liquid oxygen-enriched fraction, known as crude oxygen. The crude oxygen is further refined within the lower pressure column to produce a nitrogen tower overhead and a liquid oxygen column bottom. A stream of the liquid oxygen is pumped to the delivery pressure and then vaporized. The advantage of pumping is that expensive compressor units do not have to be used to pressurize the oxygen product stream.

Vaporization of the pumped liquid oxygen can be effected by direct heat exchange between the pumped liquid oxygen and a higher volatility stream within a mixing column. In the mixing column, the pumped liquid oxygen stream is introduced into a top region of the column and the higher volatility stream, which can simply be compressed air, is introduced into the bottom of the mixing column. The gaseous oxygen product is produced within the mixing column as a tower overhead.

In any air separation plant, there will be heat leakage into the plant through warm end losses and through heat leakage into the cold box. In order to compensate for this, refrigeration is added by way of expansion. In a common type of plant design, the incoming air stream, with or without compression, is either warmed or cooled to an intermediate temperature and is then expanded in an expansion machine with the performance of work to produce a refrigerant stream. The refrigerant stream is injected into the lower pressure column. This expanded gaseous stream, however, can have an adverse impact on the liquid to vapor ratio within the lower pressure column to decrease the production of liquid oxygen. This decrease in the production of liquid oxygen is reflected in a decrease in the production of the gaseous oxygen product.

As will be discussed, the present invention provides an air separation plant utilizing a mixing column to produce an oxygen product at an above-atmospheric pressure, air expansion to supply refrigeration, and a lower pressure column operating at an improved liquid to vapor ratio to increase oxygen production.

SUMMARY OF THE INVENTION

The present invention provides an air separation method for producing a gaseous oxygen product at an above-atmospheric delivery pressure. In accordance with the method, a compressed and purified air stream is formed and divided into first and second subsidiary streams. The first subsidiary stream is cooled to a temperature suitable for its rectification by cryogenic distillation. The second subsidiary stream is cooled to an intermediate temperature above the temperature suitable for the rectification of the first subsidiary stream. The first subsidiary stream is then introduced into an air separation unit having higher and lower pressure columns connected to one another in a heat transfer relationship so that liquid oxygen is produced as a column bottom of the lower pressure column. A liquid oxygen stream composed of the liquid oxygen is then pumped to substantially the above-atmospheric delivery pressure. The second subsidiary stream is expanded with the performance of work to form a gaseous refrigerant stream so that the gaseous refrigerant stream has substantially the above-atmospheric delivery pressure. The liquid oxygen stream is introduced into a top region of the mixing column and the gaseous refrigerant stream into the bottom region of the mixing column. A liquid refrigerant stream is withdrawn from the bottom region of the mixing column and introduced into the low pressure column. A gaseous oxygen product is formed by removing a product stream from the top region of the mixing column. The introduction of a liquid refrigerant stream will increase the liquid to vapor ratio in the low pressure column to in turn increase liquid oxygen production. The increase in liquid oxygen production will increase production of the gaseous oxygen product over potential production of the gaseous oxygen product had the gaseous refrigerant stream been directly introduced into the low pressure column.

In another aspect, the present invention provides an apparatus for separating air and for producing a gaseous oxygen product at an above-atmospheric delivery pressure. In accordance with the apparatus, a means is provided for forming a compressed and purified air stream. A means is provided for dividing the compressed and purified air stream into first and second subsidiary air streams. A heat exchange means is provided for cooling the first subsidiary stream to a temperature suitable for its rectification by cryogenic distillation and for cooling the second subsidiary stream to an intermediate temperature above the temperature of the first subsidiary stream after having been cooled. An air separation unit having higher and lower pressure columns connected to one another in a heat transfer relationship is provided. Liquid oxygen is produced as a column bottom of the lower pressure column. The higher pressure column is connected to the heat exchange means so that the first subsidiary stream is rectified within the higher pressure column to form an oxygen-rich liquid for further refinement in the lower pressure column, thereby to produce the liquid oxygen. A pump is connected to the lower pressure column for pumping a liquid oxygen stream composed of the liquid oxygen to substantially the above-atmospheric delivery pressure. An expansion means is connected to the heat exchange means for expanding the second subsidiary stream with the performance of work to form a gaseous refrigerant stream so that the gaseous refrigerant stream has substantially the above-atmospheric delivery pressure. A mixing column is connected to the pump and to the expansion means so that the liquid oxygen stream flows into the top region of the mixing column and the gaseous refrigerant stream flows into a bottom region of the mixing column. The mixing column is connected to the lower pressure column so that a liquid refrigerant stream from the bottom region of the mixing column flows into the lower pressure column. The mixing column is configured to produce the gaseous oxygen product as a product stream discharged from the top region of the mixing column. The introduction of the liquid refrigerant stream will increase the liquid to vapor ratio in the lower pressure column to in turn increase liquid oxygen production and therefore production of the gaseous oxygen product over potential production of the gaseous oxygen product had the gaseous refrigerant stream been directly introduced into the low pressure column.

It is to be noted that in the mixing column, as in any column, there will be a pressure drop from bottom to top of the mixing column. Therefore, the pressure of the gaseous refrigerant stream used to vaporize the liquid oxygen will have a pressure that will be slightly higher than the liquid oxygen pumped pressure. As used herein and in the claims, the term "substantially" is used to indicate the pressure difference between the gaseous refrigerant stream and the liquid oxygen pumped pressure.

In an air expansion plant, a stream of expanded air is introduced into the lower pressure column for refrigeration purposed. This added vapor disrupts the liquid to vapor ratio within the lower pressure column to disrupt liquid oxygen production within the lower pressure column. In the present invention by using the stream of expanded air to pressurize the pumped liquid oxygen stream and by removing a liquid refrigerant stream from the mixing column, refrigeration can be added to the lower pressure column so as not to disrupt the liquid to vapor ratio. As a result, product recovery is greater and liquid product can be produced with less of an impact on recovery than a prior art air expansion plant.

BRIEF DESCRIPTION OF THE DRAWINGS

While the specification concludes with claims distinctly pointing out the subject matter that Applicant regards as his invention, it is believed the invention will be better understood when taken in conjunction with the accompanying drawings in which:

DETAILED DESCRIPTION

Figure 1:
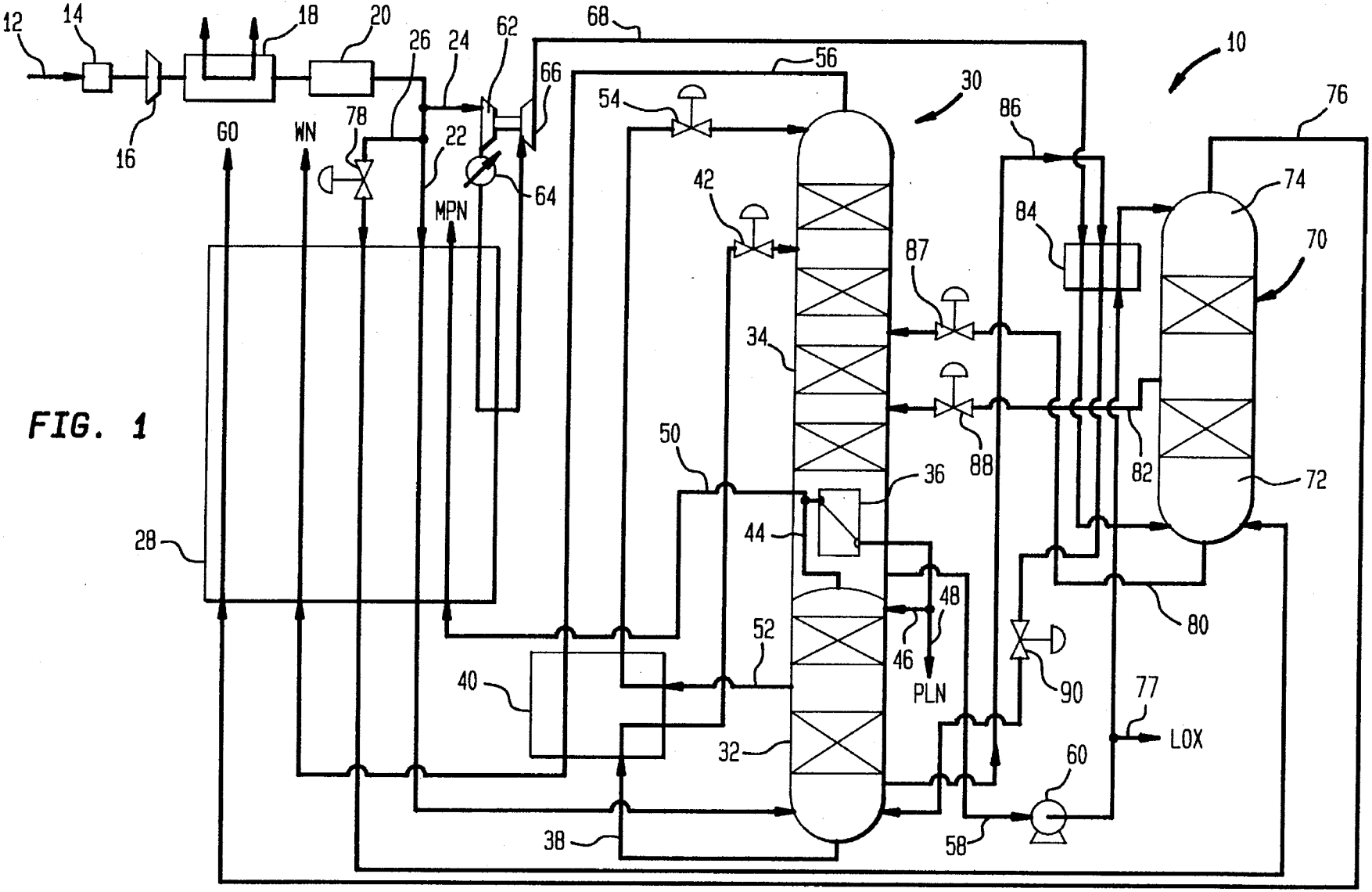
FIG. 1 is a schematic diagram of an apparatus for carrying out a method in accordance with the present invention.

With reference to FIG. 1, an apparatus 10 in accordance with the present invention is illustrated. Apparatus 10 is an air expansion plant designed to produce an oxygen product at an above-atmospheric delivery pressure of approximately 2 atm. An incoming air stream 12 in a manner well known in the art is filtered by a filter 14 and is then compressed by a main compressor 16. After removal of the heat of compression by an aftercooler 18, air stream 12 is purified within a prepurification unit 20. After cooler 18 can be a conventional water-cooled unit, a direct contact cooler, a refrigeration unit or in a potential embodiment, dispensed with entirely. Prepurification unit 20 utilizes adsorbent beds operating out of phase for regeneration purposes. The adsorbent is selected to remove typical heavy components of the air such as carbon dioxide and potentially dangerous hydrocarbons.

After air stream 12 has been compressed and purified as indicated above, it is divided into first and second subsidiary streams 22 and 24. As illustrated, air stream 12 is also preferably divided into a third subsidiary air stream 26. First subsidiary air stream 22 is cooled within a main heat exchanger 28 to a temperature suitable for its rectification by cryogenic distillation. For purposes of illustration, main heat exchanger 28 is shown as being a single unit, however, in most applications the main heat exchanger would be of plate-fin design and would consist of a series of units in parallel.

First subsidiary stream 22, which consists of the major part of the air stream, is introduced into an air separation unit 30 having higher and lower pressure columns 32 and 34 connected to one another in a heat transfer relationship by means of condenser/reboiler 36. The air contained within first subsidiary stream 22 is distilled within higher pressure column 32 into a nitrogen-rich fraction that collects as a tower overhead and an oxygen-rich fraction which collects as a column bottom. An oxygen-rich stream 38 composed of the oxygen-rich liquid is subcooled within a subcooler unit 40, is reduced in pressure to lower pressure column 34 by means of a pressure reduction valve 42, and is then introduced into lower pressure column 34 for further refinement. The further refinement produces liquid oxygen which collects as column bottom and a nitrogen vapor tower overhead. Nitrogen-rich vapor from the top of higher pressure column 32 is removed as a nitrogen-rich vapor stream 44. Nitrogen-rich vapor stream 44 is in part introduced into condenser/reboiler 36 to boil liquid oxygen produced within the bottom of lower pressure column 34. The condensate forms a reflux stream 46 which is introduced into the top of higher pressure column 32 for reflux purposes. A product liquid nitrogen stream 48 can also be removed. The other part of the nitrogen-rich vapor stream 44 forms a medium pressure nitrogen product stream 50 which after being fully warmed within main heat exchanger 28 can be sent to the customer as a medium pressure product.

In order to reflux lower pressure column 34, a reflux stream 52 is removed from the top of higher pressure column 32, pressure reduced by a pressure reduction valve 54, and introduced into the top of the lower pressure column 34. A waste nitrogen stream 56, composed of the nitrogen vapor fraction produced in lower pressure column 34, can be extracted and partially warmed within subcooler 40 to subcool oxygen-rich stream 38 and nitrogen reflux stream 52. Waste nitrogen stream 56 is then fully warmed within main heat exchanger 28 where it is expelled as a waste nitrogen stream.

A liquid oxygen stream 58 is pumped by a pump 60 to substantially the required delivery pressure of apparatus 10. At the same time, second subsidiary stream 24 is compressed by a booster compressor 62. After removal of heat of compression by an aftercooler 64, second subsidiary stream 24 is partially cooled within main heat exchanger 28 and is then expanded in an expander 66 to a pressure that is substantially the delivery pressure. Expander 66 is preferably a turboexpander coupled to booster compressor 62 to dissipate the work of expansion of expander 66 and apply at least a portion of the work to the operation of booster compressor 62. The resultant gaseous refrigerant stream 68, would in the prior art be injected directly into lower pressure column 34.

It is to be understood that a possible alternative embodiment might utilize a fully cooled air stream, partially warmed within the main heat exchanger. All that is required is that an intermediate temperature be imparted to the air stream, between the warm and cold end temperatures of main heat exchanger 28. In this regard, the term "fully warmed" as used herein and in the claims means warmed to a temperature of the warm end of main heat exchanger 28 and the term "fully cooled" means cooled to a temperature of the cold end of main heat exchanger 28.

In the present invention, gaseous refrigerant stream 68 is introduced into a mixing column 70, specifically in a bottom region 72 thereof. At the same time, liquid oxygen stream 58 after having been pumped by pump 60 is then introduced into a top region 74 of mixing column 70. The mixing column, through direct heat exchange, produces the gaseous oxygen product at the delivery pressure as tower overhead within top region 74 of mixing column 70. The gaseous oxygen product is removed from top region 74 of mixing column 70 as a product stream 76, which after having been fully warmed within main heat exchanger 28, is delivered to the customer as a product. As can be appreciated, a liquid product (as a stream 77) could be taken from pump 60.

Third subsidiary stream 26 is subjected to pressure reduction via a pressure reduction valve 78 to approximately the delivery pressure or in fact the same pressure as gaseous refrigerant stream 68. After being fully cooled within main heat exchanger 28, third subsidiary stream 26 is introduced into bottom region 72 of mixing column 70. In apparatus 10, there is not a sufficient mass flow rate of gaseous refrigerant stream 68 for the production of product within product stream 76. Therefore, the vapor is augmented by third subsidiary stream 26.

The foregoing operation permits a liquid refrigerant stream 80 to be removed from bottom region 72 of mixing column 70 and introduced into lower pressure column 34 for refrigeration purposes. Additionally, for proper operation of mixing column 70, a liquid refrigerant stream 82 should also be removed and introduced into lower pressure column 34. Liquid refrigerant stream 80 is absolutely necessary in order to maintain a heat balanced operation of mixing column 70. In this regard, it is necessary that there be more liquid than vapor within top region 74 of mixing column 70 than in bottom region 72 of mixing column 70. Liquid refrigerant stream 82, though not absolutely necessary in every possible embodiment of Applicant's invention, is necessary in apparatus 10 to ensure that mixing column 10 operates at a minimum reflux ratio beneath its takeoff point from mixing column 70. This increases efficiency of mixing column 70. Also, for the sake of efficiency of mixing column 70, liquid oxygen stream 58 by being pumped by pump 60 is in a subcooled state. It is therefore necessary to warm liquid oxygen stream 58 to closer approach a saturated state before introduction into top region 74 of mixing column 70. This is done through an auxiliary heat exchanger 84 which further cools gaseous refrigerant stream 68 and an auxiliary crude liquid oxygen stream 86 which is removed and returned back to higher pressure column 32. Optionally, third subsidiary stream 26 can be cooled in heat exchanger 84 modified with a pass designed to accommodate third subsidiary stream 26. As illustrated, appropriate pressure reduction valves 87, 88 and 90 are provided to allow for the flow of streams 80, 82 and 86 into high and low pressure columns 32 and 34.

Figure 2:
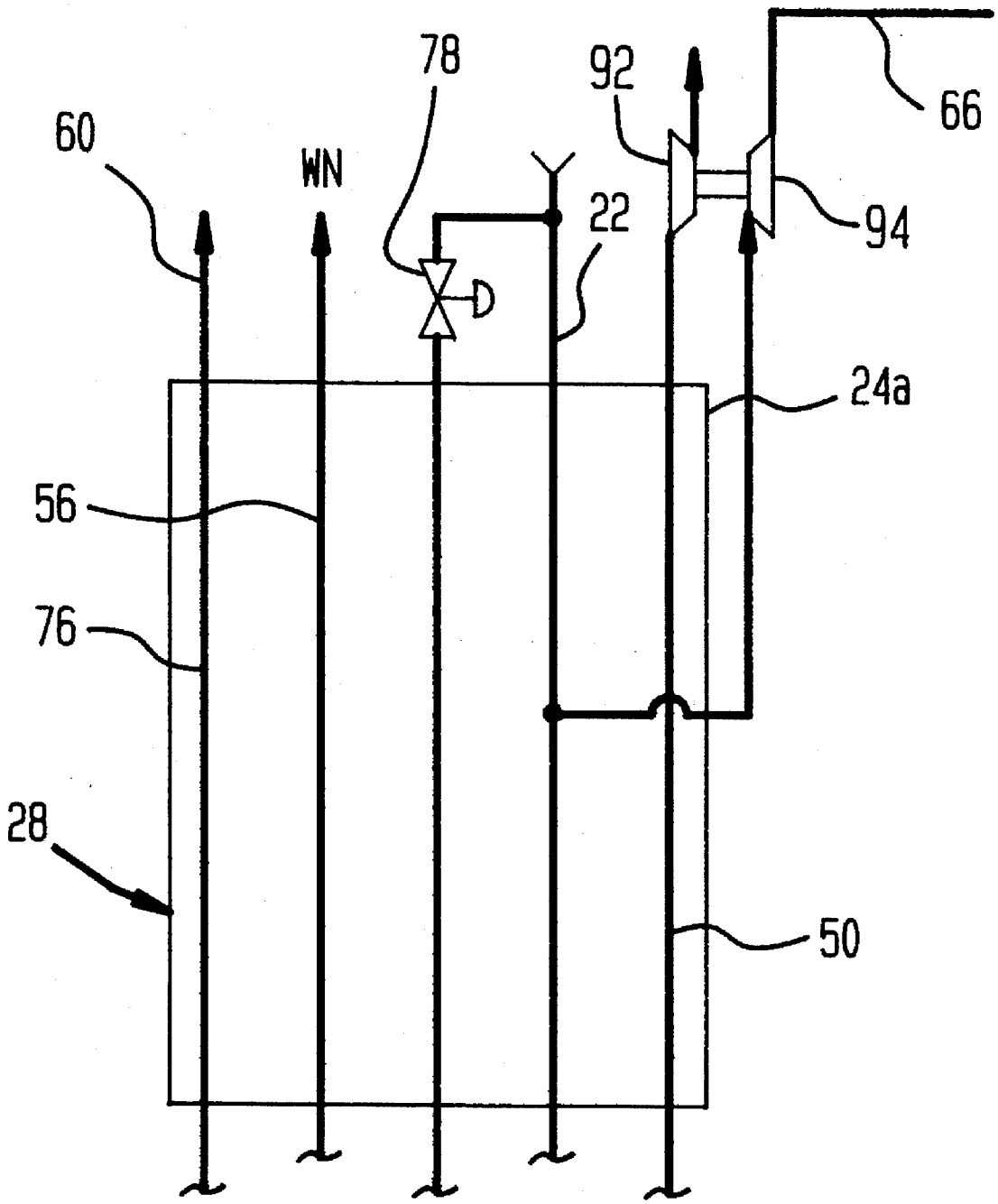
FIG. 2 is a fragmentary view of an alternative embodiment of FIG. 1. The same reference numerals have been retained in FIG. 1 to indicate like elements performing the same or similar functions.

With reference to FIG. 2, an alternative embodiment of apparatus 10 is illustrated. In such embodiment, medium pressure nitrogen stream 50 is compressed against the turboexpansion of a second subsidiary stream **24*a* through use of a compressor 92 coupled to a turboexpander 94. Although not illustrated, an auxiliary crude liquid oxygen stream 86 is not utilized in such embodiment. Gaseous oxygen stream 68 is further cooled against the heating of liquid oxygen stream 58 in a heat exchanger that would serve the same purpose as auxiliary heat exchanger 84 but not have a passageway for auxiliary crude liquid oxygen stream 86**.

The following is a calculated example in tabular form illustrating the operation of apparatus 10. It is to be noted that mixing column 70 has stages formed by sieve or bubble cap trays, structured packing and etc.

| Stream | Vapor Fraction | Temperature (C) | Pressure (atm) | Mass Flow (kg/h) | $O_2$ Composition (mole fraction %) |
|---|---|---|---|---|---|
| Air stream 12 after prepurification unit 20 | 1.00 | 11.11 | 5.17 | 55407.65 | 0.21 |
| First subsidiary stream 22 after main heat exchanger 28 | 0.98 | −174.65 | 5.02 | 42688.69 | 0.21 |
| Second subsidiary stream 24 before main heat exchanger 28 | 1.00 | 7.78 | 7.02 | 6114.89 | 0.21 |
| Gaseous refrigerant stream 68 | 1.00 | −157.03 | 2.14 | 6114.89 | 0.21 |
| Gaseous refrigerant stream 68 after auxiliary heat exchanger 84 | 1.00 | −176.11 | 2.03 | 6114.89 | 0.21 |
| Auxiliary crude liquid oxygen stream 86 | 1.00 | −174.70 | 5.01 | 712.85 | 0.20 |
| Third subsidiary stream 26 | 1.00 | −174.62 | 2.03 | 6604.08 | 0.21 |
| Product stream 76 after main heat exchanger 28 | 1.00 | 8.67 | 1.90 | 12974.35 | 0.95 |
| Liquid oxygen stream 58 prior to mixing column 70 | 0.00 | −176.79 | 2.02 | 36711.00 | 0.99 |

-continued

| Stream | Vapor Fraction | Temperature (C) | Pressure (atm) | Mass Flow (kg/h) | $O_2$ Composition (mole fraction %) |
|---|---|---|---|---|---|
| Liquid refrigeration stream 80 | 0.00 | −183.97 | 2.03 | 15039.99 | 0.55 |
| Liquid refrigeration stream 82 | 0.00 | −179.54 | 2.03 | 21415.62 | 0.83 |
| Medium pressure nitrogen product stream 50 | 1.00 | −179.17 | 4.95 | 3253.31 | 0.00 |

It will be understood by those skilled in the art that although the invention has been described relative to a preferred embodiment, numerous changes, additions and omissions may be made without departing from the spirit and scope of the present invention.

We claim:

1. An air separation method for producing a gaseous oxygen product at a delivery pressure:

forming a compressed and purified air stream and dividing said compressed and purified air stream into first and second subsidiary streams;

cooling said first subsidiary stream to a temperature suitable for its rectification by cryogenic distillation;

cooling said second subsidiary stream to an intermediate temperature above said temperature suitable for said rectification of said first subsidiary stream;

introducing said first subsidiary stream into an air separation unit having higher and lower pressure columns connected to one another in a heat transfer relationship so that liquid oxygen is produced as a column bottom of the lower pressure column;

pumping a liquid oxygen stream composed of said liquid oxygen to substantially said delivery pressure;

expanding said second subsidiary stream with the performance of work to form a gaseous refrigerant stream so that said gaseous refrigerant stream has substantially said delivery pressure;

introducing said liquid oxygen stream into a top region of a mixing column and said gaseous refrigerant stream into a bottom region of said mixing column;

withdrawing a liquid refrigerant stream from said bottom region of said mixing column and introducing said liquid refrigerant stream into said low pressure column; and forming said gaseous oxygen product by removing a product stream from the top of said mixing column, whereby the introduction of said liquid refrigerant stream will increase the liquid to vapor ratio in said low pressure column to in turn increase liquid oxygen production and therefore production of said gaseous oxygen product over potential production of said gaseous oxygen product had said gaseous refrigerant stream been directly introduced into said low pressure column.

2. The method of claim 1 further comprising:

further compressing said second subsidiary stream;

removing heat of compression from said second subsidiary stream;

recovering at least part of the performance of work of expansion and applying said work to the compression of said second subsidiary stream.

3. The method of claim 2 wherein:

nitrogen-rich vapor is produced as tower overhead in said higher pressure column;

a medium pressure nitrogen stream composed of said nitrogen-rich vapor is removed from said higher pressure column and fully warmed;

said medium pressure nitrogen stream is compressed to a nitrogen delivery pressure; and at least part of the work of expansion is recovered and applied to the compression of said medium pressure nitrogen stream.

4. The method of claim 1 or claim 2 wherein:

said compressed and purified air stream has a pressure above said delivery pressure;

said compressed and purified air stream is further divided into a third subsidiary air stream;

said third subsidiary air stream is reduced in pressure to substantially said delivery pressure; and said third subsidiary air stream is fully cooled and then introduced into said bottom region of said mixing column.

5. The method of claim 4 wherein an intermediate liquid refrigeration stream is removed from the mixing column and introduced into said lower pressure column.

6. The method of claim 5 wherein:

said liquid oxygen stream is in a subcooled state after having been pumped; and said gaseous refrigerant stream is heat exchanged with said liquid oxygen stream so that said liquid oxygen stream is in a saturated state and said gaseous refrigerant stream further cools.

7. The method of claim 6 wherein:

a nitrogen vapor collects as tower overhead in said lower pressure column;

a waste nitrogen stream composed of said nitrogen vapor is removed from said lower pressure column; and said product stream, said waste nitrogen stream and said medium pressure nitrogen product stream fully warm and pass in counter-current, indirect heat exchange with said first and third subsidiary streams.

8. An apparatus for separating air and for producing a gaseous oxygen product at a delivery pressure:

means for forming a compressed and purified air stream;

means for dividing said compressed and purified air stream into first and second subsidiary streams;

heat exchange means for cooling said first subsidiary stream to a temperature suitable for its rectification by cryogenic distillation and for cooling said second subsidiary stream to an intermediate temperature above said temperature of said first subsidiary stream after having been cooled;

an air separation unit having higher and lower pressure columns connected to one another in a heat transfer relationship so that liquid oxygen is produced as a column bottom of the lower pressure column, said higher pressure column connected to said heat exchange means so that said first subsidiary stream is rectified within said higher pressure column to form an oxygen rich liquid for further refinement in said lower pressure column, thereby to produce said liquid oxygen;

a pump connected to said lower pressure column for pumping a liquid oxygen stream composed of said liquid oxygen to substantially said delivery pressure;

expansion means connected to said heat exchange means for expanding said second subsidiary stream with the performance of work to form a gaseous refrigerant stream so that said gaseous refrigerant stream has substantially said delivery pressure;

a mixing column connected to said pump and said expansion means so that said liquid oxygen stream flows into a top region of said mixing column and said gaseous refrigerant stream flows into a bottom region of said mixing column;

said mixing column connected to said lower pressure column so that a liquid refrigerant stream from said bottom region of said mixing column flows into said lower pressure column; and said mixing column configured to produce said gaseous oxygen product as product stream discharged from said top region of said mixing column, whereby the introduction of said liquid refrigerant stream will increase the liquid to vapor ratio in said lower pressure column to in turn increase liquid oxygen production and therefore production of said gaseous oxygen product over potential production of said gaseous oxygen product had said gaseous refrigerant stream been directly introduced into said low pressure column.

9. The apparatus of claim 8 further comprising:

a booster compressor connected to said dividing means for further compressing said second subsidiary stream;

an after cooler connected to said booster compressor for removing heat of compression from said second subsidiary stream;

said heat exchange means configured to partially cool said second subsidiary stream to impart said intermediate temperature thereto; and said booster compressor coupled to said expansion means for recovering the performance of work of expansion and applying said work to the compression of said second subsidiary stream.

10. The apparatus of claim 8, further comprising:

said higher pressure column also connected to said heat exchange means so that a medium pressure nitrogen stream composed of nitrogen-rich vapor produced in said higher pressure column is fully warmed;

a compressor for compressing said medium pressure nitrogen stream to a nitrogen delivery pressure; and said compressor coupled to said expansion means so that the work of expansion is recovered in the compression of said medium pressure nitrogen stream.

11. The apparatus of claim 9 or claim 10 wherein:

said compression and purification means compresses said compressed and purified air stream to a pressure above said delivery pressure;

a pressure reduction valve connected to said compression and purification means so that said compressed and purified air stream is further divided into a third subsidiary air stream reduced in pressure to substantially said delivery pressure;

said heat exchange means is configured to fully cool said third subsidiary stream; and said mixing column is connected to said main heat exchange means so that said third subsidiary stream flows into said bottom region of said mixing column.

12. The apparatus of claim 11 wherein said mixing column is connected to said lower pressure column so that an intermediate liquid refrigeration stream flows from the mixing column and into said lower pressure column.

13. The apparatus of claim 12 further comprising means for exchanging heat between said gaseous refrigerant stream and said liquid oxygen stream so that said liquid oxygen stream is in a saturated state and said gaseous refrigerant stream further cools.

14. The apparatus of claim 13, wherein said heat exchange means is connected to said lower pressure column and is configured for fully warming said product stream, a waste nitrogen stream composed of nitrogen vapor collected as tower overhead in said lower pressure column, and said medium pressure nitrogen product stream and for passing said first and third subsidiary streams in countercurrent, indirect heat exchange with said product, waste nitrogen, and medium pressure nitrogen product streams.

* * * * *

UNITED STATES PATENT AND TRADEMARK OFFICE

CERTIFICATE OF CORRECTION

PATENT NO. : 5,454,227
DATED : Oct. 3, 1995
INVENTOR(S) : Joseph Straub and Neil Hogg It is certified that error appears in the above-identified patent and that said Letters Patent is hereby corrected as shown below:

Cover Page, [75] Change 2nd inventor's name from
Neil Nogg to -- Neil Hogg

Signed and Sealed this

Twenty-fourth Day of February, 1998

*Attest:*

Bruce Lehman

BRUCE LEHMAN

*Attesting Officer*

*Commissioner of Patents and Trademarks*